US006422650B1

(12) United States Patent
Chien-Shen

(10) Patent No.: US 6,422,650 B1
(45) Date of Patent: Jul. 23, 2002

(54) SEAT PAD ADJUSTING STRUCTURE OF A CHAIR

(75) Inventor: Ma Chien-Shen, Taichung Hsien (TW)

(73) Assignee: The e chair company (TW)

( * ) Notice: Subject to any disclaimer, the term of this patent is extended or adjusted under 35 U.S.C. 154(b) by 0 days.

(21) Appl. No.: 09/875,705

(22) Filed: Jun. 6, 2001

(51) Int. Cl.[7] ..... A47C 1/02
(52) U.S. Cl. ..... 297/312; 297/284.11; 297/452.21
(58) Field of Search ..... 297/312, 201, 297/284.3, 284.11, 313, 452.21

(56) References Cited

U.S. PATENT DOCUMENTS

| | | | | | |
|---|---|---|---|---|---|
| 4,498,702 | A | * | 2/1985 | Raftery | 297/312 |
| 4,775,185 | A | * | 10/1988 | Scholin et al. | 297/312 X |
| 5,716,099 | A | * | 2/1998 | McDiarmid | 297/284.11 X |
| 5,904,397 | A | * | 5/1999 | Fismen | 297/312 X |

FOREIGN PATENT DOCUMENTS

| | | | | |
|---|---|---|---|---|
| FR | 2584587 | * | 1/1987 | 297/452.21 |
| JP | 0075842 | * | 4/1984 | 297/284.11 |
| JP | 0013838 | * | 1/1988 | 297/284.11 |

* cited by examiner

*Primary Examiner*—Laurie K. Cranmer
(74) *Attorney, Agent, or Firm*—Connolly Bove Lodge & Hutz, LLP

(57) ABSTRACT

A seat pad adjusting structure of a chair includes a base having a first side formed with an oblique catch extending downward in an inclined manner, and a second side provided with a backrest connecting bracket, a bottom plate mounted on the base and including a base plate secured on the base, an elongated hollow flexible member having a first side formed on one side of the base plate, a swingable flap formed on a second side of the flexible member and located above the oblique catch of the base, and an elongated elastic pad mounted in the flexible member, and a seat pad, mounted on the base plate.

3 Claims, 5 Drawing Sheets

SEAT PAD ADJUSTING STRUCTURE OF A CHAIR

BACKGROUND OF THE INVENTION

1. Field of the Invention

The present invention relates to a seat pad adjusting structure of a chair, and more particularly to a seat pad adjusting structure satisfying the requirement of the ergonomic design.

2. Description of the Related Art

A conventional chair in accordance with the prior art shown in FIG. 1 comprises a seat pad and a backrest 52. When the backrest 52 is adjusted to have an inclined angle so as to fit the user's requirement, the seat pad 50 is also moved with the backrest 52 to have an inclined angle, so that the front side 51 of the seat pad 50 is lifted synchronously. However, the inner side of the user's leg is compressed by the inclined front side 51 of the seat pad 50, thereby easily causing uncomfortable sensation to the user during long-term utilization, and thereby easily poorly affecting the blood circulation of the user.

SUMMARY OF THE INVENTION

The present invention has arisen to mitigate and/or obviate the disadvantage of the conventional chair.

The primary objective of the present invention is to provide a seat pad adjusting structure of a chair satisfying the requirement of the ergonomic design.

Another objective of the present invention is to provide a seat pad adjusting structure of a chair, wherein the manner of action of the seat pad may be adapted to satisfy the requirement of the optimal ergonomic design, thereby providing a comfortable sensation to the user.

A further objective of the present invention is to provide a seat pad adjusting structure of a chair, wherein the front side of the seat pad can be maintained at a horizontal state even when the seat pad is disposed at an inclined manner, so that the user's leg can be maintained at the horizontal state without inclination, thereby satisfying the requirement of an ergonomic design, so that the user may feel comfortable when the seat pad is disposed at an inclined manner.

In accordance with the present invention, there is provided a seat pad adjusting structure of a chair, comprising:

a base, having a first side formed with an oblique catch extending downward in an inclined manner, and a second side provided with a backrest connecting bracket;

a bottom plate, mounted on the base and including a base plate secured on the base, an elongated hollow flexible member having a first side formed on one side of the base plate, a swingable flap formed on a second side of the flexible member and located above the oblique catch of the base, and an elongated elastic pad mounted in the flexible member; and a seat pad, mounted on the base plate.

Further benefits and advantages of the present invention will become apparent after a careful reading of the detailed description with appropriate reference to the accompanying drawings.

DETAILED DESCRIPTION OF THE INVENTION

Figure 1:
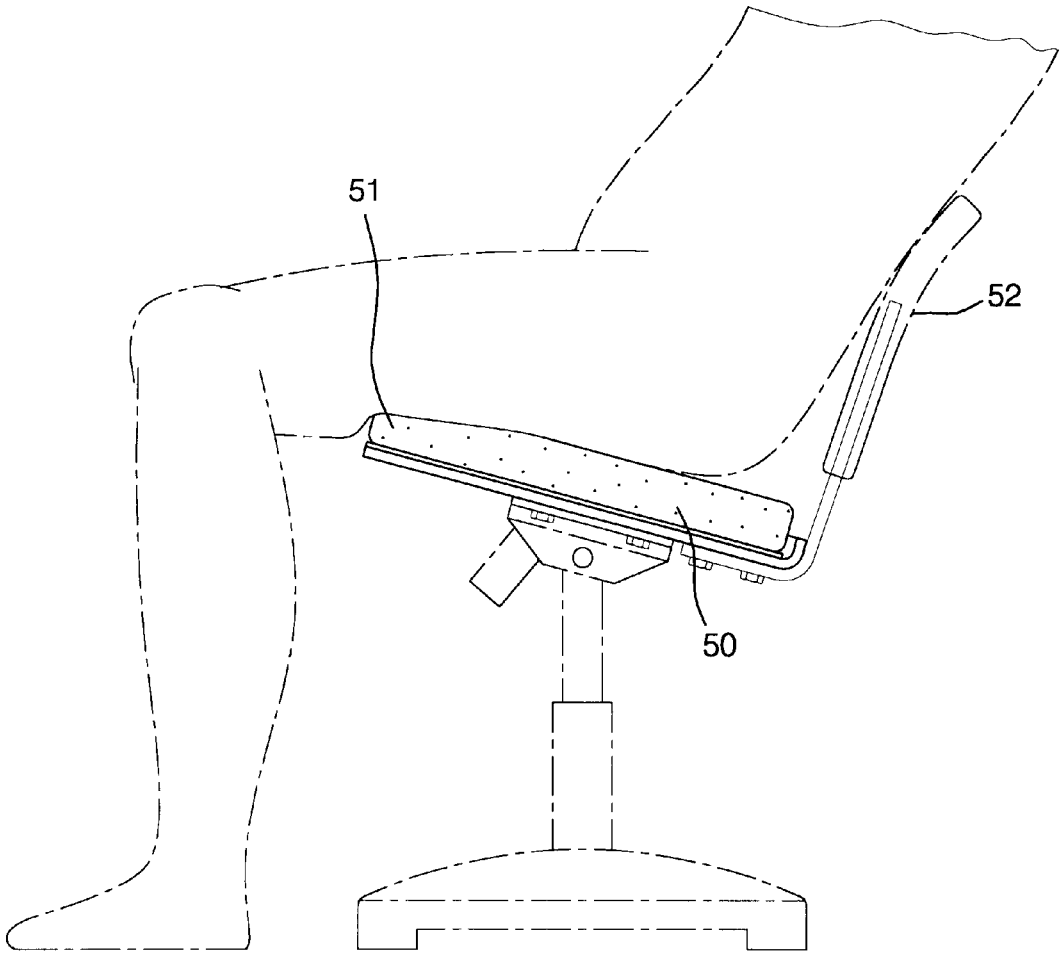
FIG. 1 (PRIOR ART)
FIG. 1 is a schematic side plan view of a conventional chair in accordance with the prior art.

Referring to the drawings and initially to FIGS. 2–6, a seat pad adjusting structure of a chair in accordance with the present invention comprises a base 10, a bottom plate 20, and a seat pad 30 made of soft material.

The base 10 is secured on a seat support rod 18 by screws or the like, and has a front side formed with an oblique catch 11 extending downward in an inclined manner, and a rear side screwed with a backrest connecting bracket 15 which is provided with a backrest 16 (see FIG. 8), so that the backrest 16 may be moved in concert with the base 10.

The bottom plate 20 is mounted on the base 10 and includes a base plate 21 secured on the base 10, an elongated hollow flexible member 22 having a first side formed the front side of the base plate 21, a swingable flap 24 formed on a second side of the flexible member 22 and located above the oblique catch 11 of the base 10, and an elongated elastic pad 25 made of rubber material mounted in the flexible member 22. The swingable flap 24 and the base plate 21 may be maintained at the same plane by means of the restoring elasticity of the elongated elastic pad 25 as shown in FIG. 6.

Figure 3:
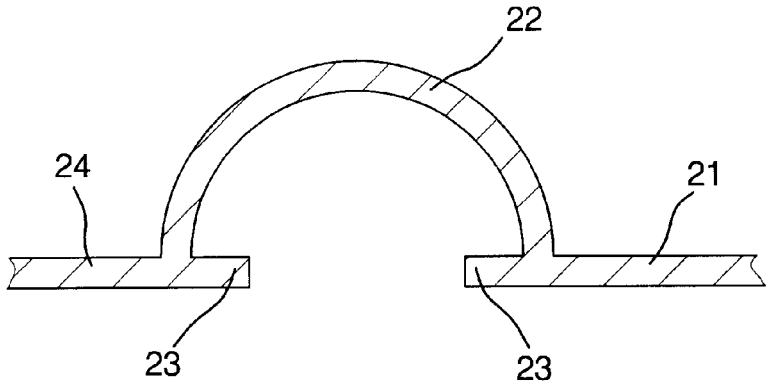
FIG. 3 is a cross-sectional view of a swingable flap of the seat pad adjusting structure of a chair as shown in FIG. 2.
Figure 4:
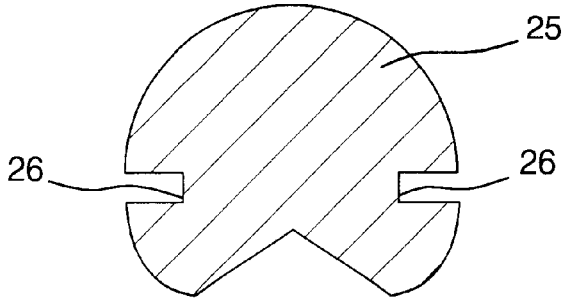
FIG. 4 is a cross-sectional view of an elastic pad of the seat pad adjusting structure of a chair as shown in FIG. 2.
Figure 5:
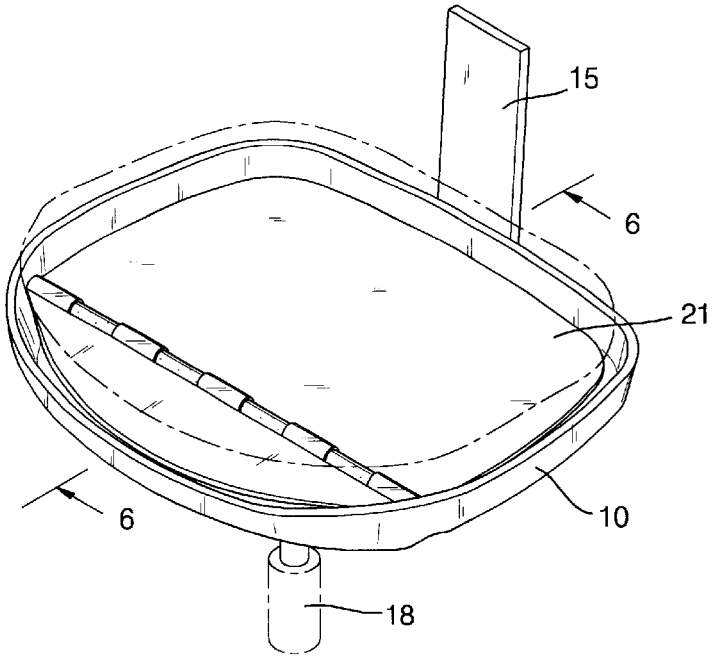
FIG. 5 is a perspective assembly view of the seat pad adjusting structure of a air as shown in FIG. 2.

As shown in FIGS. 3 and 4, the two sides of the elongated flexible member 22 are formed with two elongated parallel guide rails 23 protruded inward, and the elastic pad 25 has two sides each defining an elongated guide track 26 for slidably receiving a respective one of the two guide rails 23. Thus, the swingable flap 24 has an elastic restoring function by the restoring elasticity of the elongated elastic pad 25.

The seat pad 30 made of soft material is mounted on the top face of the base plate 20.

Figure 2:
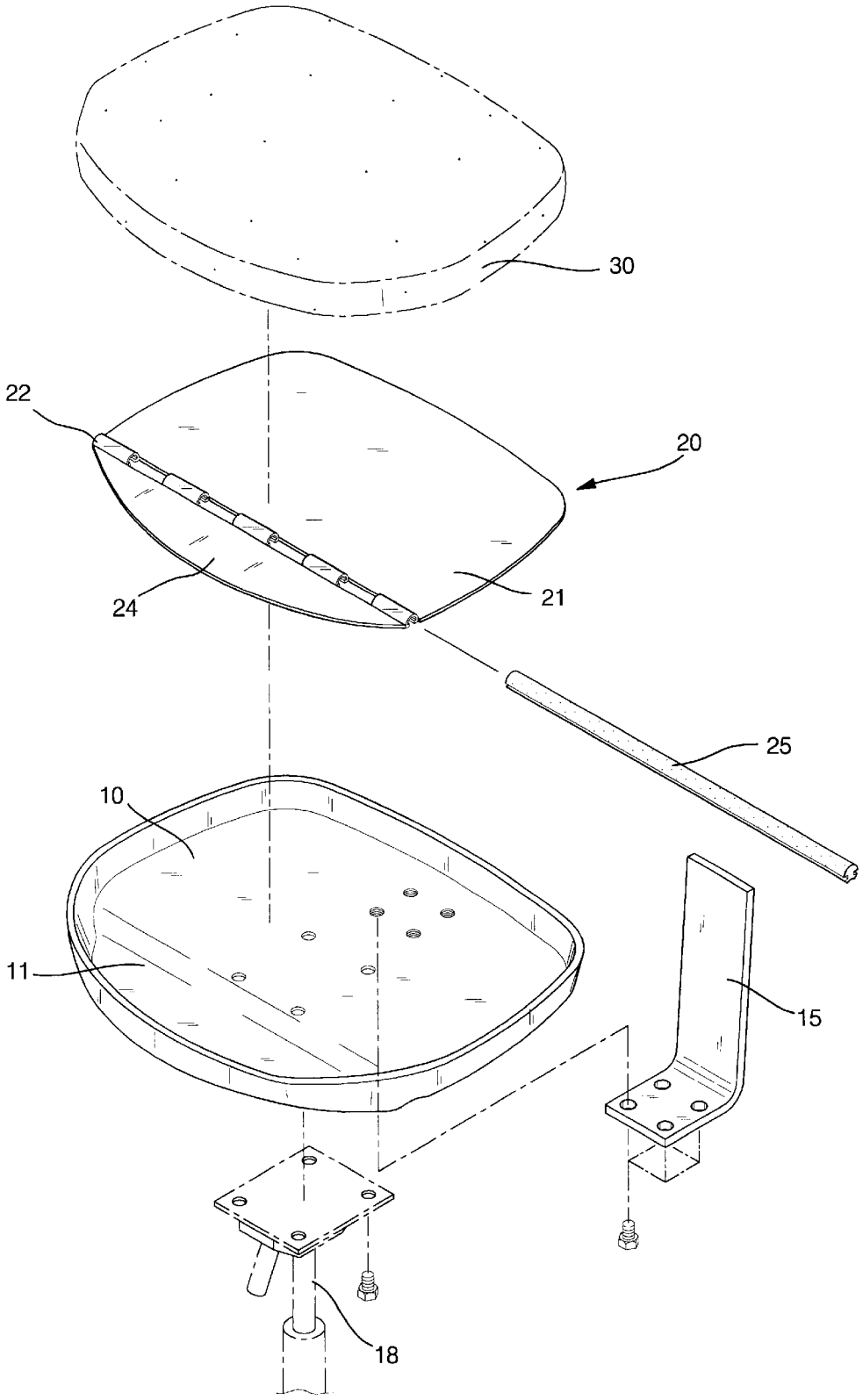
FIG. 2 an exploded perspective view of a seat pad adjusting structure of chair in accordance with the present invention.
Figure 6:
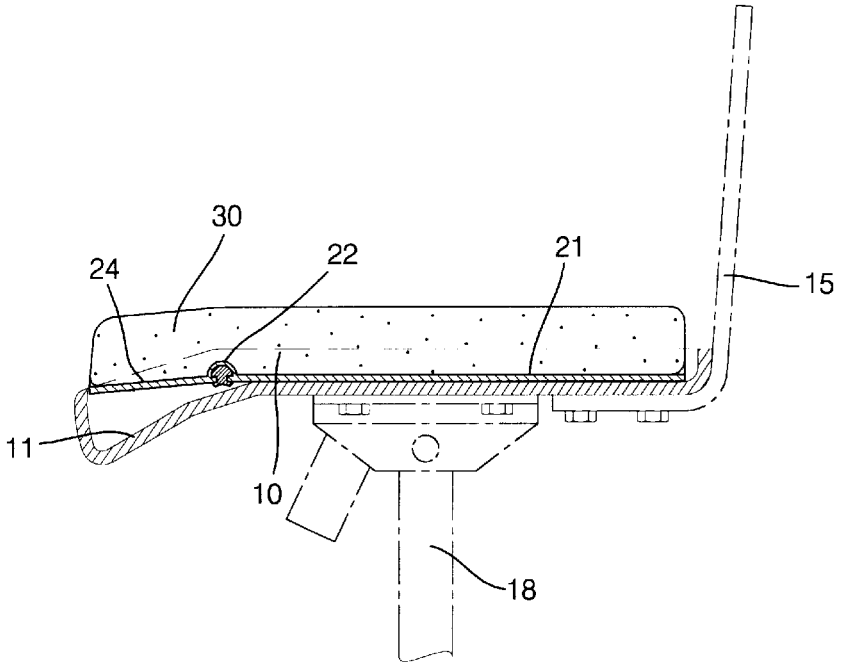
FIG. 6 is a side plan cross-sectional view of the seat pad adjusting structure as shown in FIG. 5.
Figure 7:
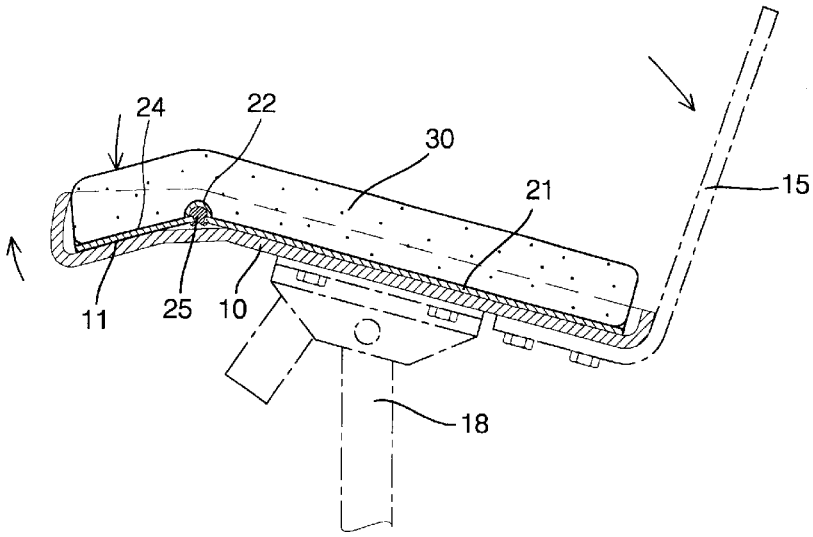
FIG. 7 i s a schematic operational view of the seat pad adjusting structure of a chair as shown in FIG. 6 in use.
Figure 8:
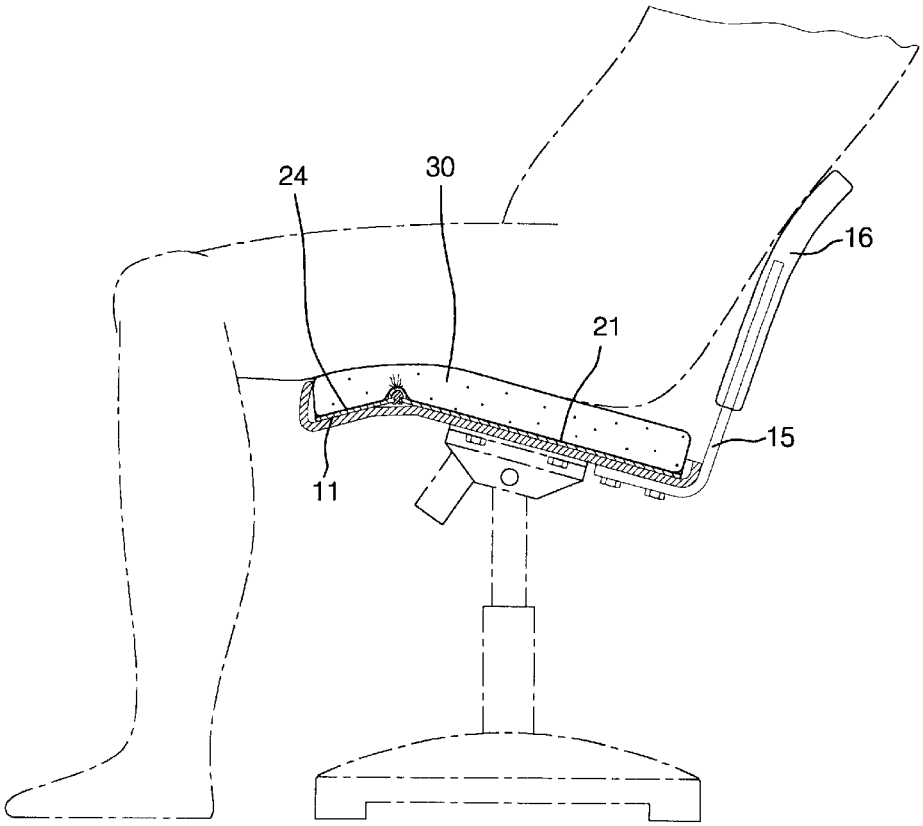
FIG. 8 is a schematic operational view of the seat pad adjusting structure of a chair as shown in FIG. 7 in use.

In operation, referring to FIGS. 6–8 with reference to FIG. 2, the swingable flap 24 is initially located above the oblique catch 11 of the base 10 with a gap defined therebetween. When the user is seated on the seat pad 30 as shown in FIG. 8, the seat pad 30 will exert a downward force on the swingable flap 24 which is pressed to move downward from the position as shown in FIG. 6 to the position as shown in FIG. 7 until the swingable flap 24 is stopped by the oblique catch 11 of the base 10. The oblique catch 11 of the base 10 can be used to prevent the swingable flap 24 from being moved downward excessively, thereby maintaining a constant included angle between the base plate 21 and the swingable flap 24.

When the user leaves the seat pad 30, the downward force applied on the swingable flap 24 is removed, such that the swingable flap 24 can be moved upward from the position as shown in FIG. 7 to the original position as shown in FIG. 6 by means of the restoring elasticity of the elongated elastic pad 25.

In such a manner, the stress applied on the front side of the seat pad 30 is evenly distributed and transmitted through the swingable flap 24 to the elastic pad 25, so that the stress applied on the front side of the seat pad 30 is evenly absorbed by the elastic pad 25. Thus, when the seat pad 30 is inclined rearward with the backrest 16, the front side of the seat pad 30 is subjected to the downward load of gravity from the leg of the user. At the same time, the front side of the seat pad 30 and the swingable flap 24 of the base plate 20 are synchronously moved downward in an inclined manner, so that the front side of the seat pad 30 is maintained at a substantially horizontal state as shown in FIG. 8. Thus, the front side of the seat pad 30 can be maintained at a horizontal state even when the seat pad 30 is disposed at an inclined manner, so that the user's leg can be maintained at the horizontal state without inclination, thereby satisfying the requirement of the ergonomic design. Thus, the user may feel comfortable when the seat pad 30 is disposed at an inclined manner.

Accordingly, the manner of action of the seat pad 30 may be adapted to satisfy the requirement of the optimal ergonomic design, thereby providing a comfortable sensation to the user.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A seat pad adjusting structure of a chair, comprising:

a base (10), having a first side formed with an oblique catch (11) extending downward in an inclined manner, and a second side provided with a backrest connecting bracket (15);

a bottom plate (20), mounted on said base (10) and including a base plate (21) secured on said base (10), an elongated hollow flexible member (22) having a first side formed on one side of said base plate (21), a swingable flap (24) formed on a second side of said flexible member (22) and located above said oblique catch (11) of said base (10), and an elongated elastic pad (25) mounted in said flexible member (22); and a seat pad (30), mounted on said base plate (20).

2. The seat pad adjusting structure of a chair in accordance with claim 1, wherein said base (10) is secured on a seat support rod (18).

3. The seat pad adjusting structure of a chair in accordance with claim 1, wherein said first side and second side of said elongated flexible member (22) are formed with two elongated parallel guide rails (23), and said elastic pad (25) has two sides each defining an elongated guide track (26) for slidably receiving a respective one of said two guide rails (23).

* * * * *